US005894697A

United States Patent [19]

Hunter

[11] Patent Number: 5,894,697

[45] Date of Patent: Apr. 20, 1999

[54] FLASHING FOR SIDING

[76] Inventor: Alton G. Hunter, 9800 Chandler Dr., Raleigh, N.C. 27615

[21] Appl. No.: 08/901,863

[22] Filed: Jul. 28, 1997

[51] Int. Cl.[6] ..... E04D 1/36

[52] U.S. Cl. ..... 52/58; 52/302.6; 52/254

[58] Field of Search ..... 52/58, 302.6, 254, 52/255, 287.1, 288.1; 428/603, 598

[56] References Cited

U.S. PATENT DOCUMENTS

| | | | |
|---|---|---|---|
| 2,245,965 | 6/1941 | Cunin | 52/302.6 X |
| 3,461,625 | 8/1969 | Sandow | 52/58 |
| 4,876,837 | 10/1989 | Kelly et al. | 52/254 X |
| 5,289,663 | 3/1994 | Schluter | 52/287.1 |
| 5,544,463 | 8/1996 | Bergin | 52/254 |

FOREIGN PATENT DOCUMENTS

| | | | |
|---|---|---|---|
| 290910 | 12/1966 | Australia | 52/255 |
| 0638697 | 2/1995 | European Pat. Off. | 52/255 |
| 1289328 | 2/1962 | France | 52/254 |
| 2056523 | 3/1981 | United Kingdom | 52/255 |

*Primary Examiner*—Lanna Mai

*Attorney, Agent, or Firm*—Mills Law Firm PLLC

[57] ABSTRACT

To overcome the difficulties of properly spacing the lower terminal edge of siding above a roof with flashing therebetween, an outwardly projecting elongated guide is formed in the elongated vertical portion of the siding at the predetermined level above the elongated horizontal portion of the flashing. This allows the installer to use the guide to properly cut the siding as well as installing the same the correct distance above the roof. If an attempt is made to install siding to close to the roof, the same will not lie flat against the flashing so that an obvious incorrect installation is indicated.

4 Claims, 5 Drawing Sheets

FLASHING FOR SIDING

BACKGROUND OF INVENTION

As natural products such as building lumber have become more scarce and thus expensive, manufactured building products have been developed. Primed lap sidings are a good example of this and are widely used today in the building industry.

Shortly after primed lap sidings were introduced to the market, problems developed in the lower boards rotting adjacent roof areas where flashing was placed behind the siding and under the shingles in the normal manner.

As a result of this, manufacturers now require that the bottom of the sidings stop one inch above the roof shingle to prevent moisture from absorbing into the bottom edge thereof.

As a result of the above, it is a widespread practice for the carpenters to use a one by four inch board as a guide. One by fours, however, are in reality only three quarters of an inch thick and if rot occurs, this could void the manufacturers' warranty on the siding. Other carpenters guess at the one-inch spacing, quite often resulting in uneven cuts, particularly on dormers and the like.

CONCISE EXPLANATION OF PRIOR ART

U.S. Pat. No. 5,519,969 to Thomas R. Golba discloses a removable roof flashing cover system with a plurality of complicated bins, grooves and punched out slots.

U.S. Pat. No. 5,392,576 to Robert C. Yeamans is considered of interest in that it discloses a roof deck covering system securement means including a longitudinal slot with a retainer insert.

U.S. Pat. No. 5,109,641 to Peter Halan discloses a roof transition flashing specifically designed for installation on a building at the juncture between a vertical wall and an edge of the sloped roof.

U.S. Pat. No. 3,698,142 to George R. Theriault discloses flashing having a V-shape disposition with a forward lip portion that is bent under the shingle.

U.S. Pat. No. 5,337,526 to Lewis C. Hartman is considered of interest in that it discloses a step flashing strip having a plurality of flashing segments to allow insertion of shingles.

U.S. Pat. No. 4,434,590 to Roger B. Wheeler discloses flashing structure to geodetic dome structures with a seal disposed intermediate nesting portions.

U.S. Pat. No. 2,974,448 to Morley M. Weis discloses a flashing construction that includes an easily removable spring that holds the flashing in position.

U.S. Pat. No. 596,266 to Thomas J. Hind is considered of interest in that it discloses flashing for use in building construction including an overhang fold about three inches wide to deflect water away from the wall.

BRIEF DESCRIPTION OF INVENTION

After much research and study into the above-mentioned problems, the present invention has been developed to provide a modified roof flashing that correctly spaces siding above the shingles of a building structure. This automatically measures/locates the run of the siding and spaces the same accurately within the required clearance to maintain warranty of the siding.

The flashing of the present invention can be made of galvanized metal, aluminum, vinyl, plastic or other suitable material.

In view of the above, it is an object of the present invention to provide an improved roof flashing that definitely defines the termination line of siding above the adjacent roof.

Another object of the present invention is to provide an improved roof flashing in the form a longitudinal shoulder that acts as a positive guide for the installation of the terminal edge of wall siding above an adjacent roof.

Another object of the present invention is to provide an improved roof flashing with outwardly projecting means that act as a positive guide to the installation of wall siding and to prevent the installation of such siding closer than proper to the roof.

Another object of the present invention is to provide an improved roof flashing with means for positively preventing improper installation of the thermal edge of wall siding below a predetermined location. Other objects and advantages of the present invention will become apparent and obvious from a study of the following description and the accompanying drawings which are merely illustrative of such invention.

DETAILED DESCRIPTION OF INVENTION

Figure 1A:
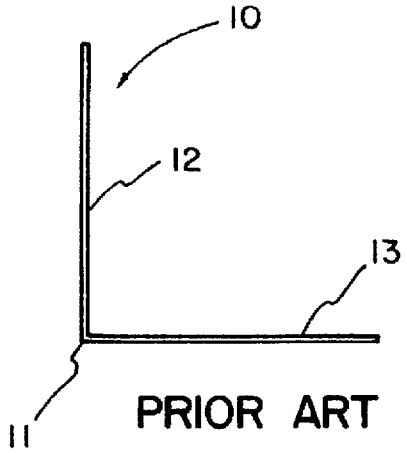
PRIOR ART FIG. 1A
FIG. 1A is an end elevational view of the prior art flashing.
Figure 1B:
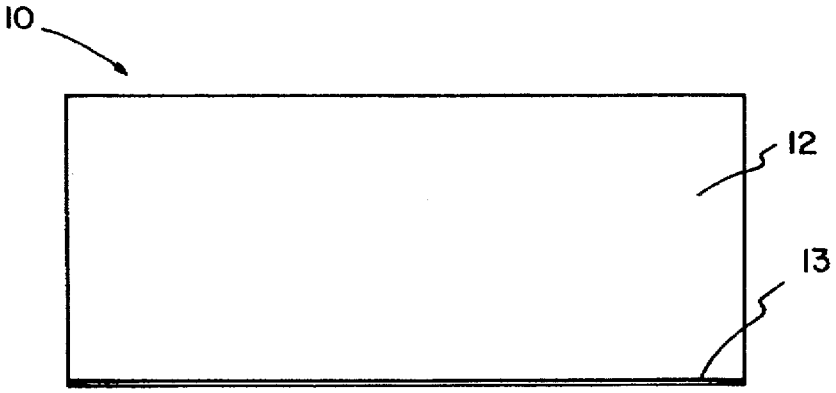
PRIOR ART FIG. 1B
FIG. 1B is a front elevational view of the prior art flashing.
Figure 1C:
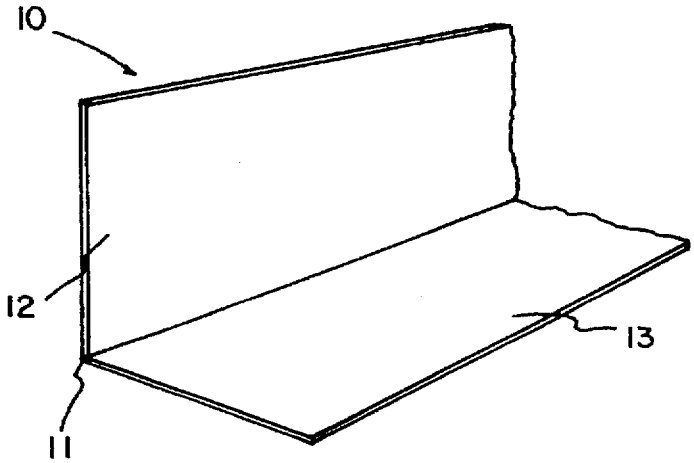
PRIOR ART FIG. 1C
FIG. 1C is a fragmentary perspective view thereof.

The prior art flashing shown in FIG. 1A through 1C is composed of an elongated strip of galvanized metal, copper or the like, indicated generally at 10, having a longitudinal 90° bend 11 therein. Flashing of this type is universally used in the building trade and is used for many purposes including flashing between wall siding and roof shingles. When installed, the prior art flashing has a vertical portion 12, a horizontal portion 13 and a bend line 11.

The improved roof flashing of the present invention, indicated generally at 14, includes a generally vertical portion 12' and generally horizontal portion 13' with a bend line 11'. There is a longitudinal double-crimp lip guide 15 in the vertical portion 12' approximately one inch above the juncture 11' with vertical portion 12'. This double-crimp lip extends the entire length of the improved flashing 14 and provides a predetermined separation of the siding being installed from the roof. This, of course, aids the installer (not shown) to correctly cut the siding and to fit the same accurately along its terminal edge.

Figure 2A:
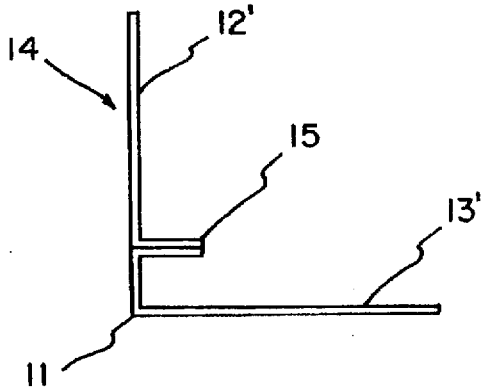
FIG. 2A is an end elevational view of one form of the improved roof flashing of the present invention.
Figure 2B:
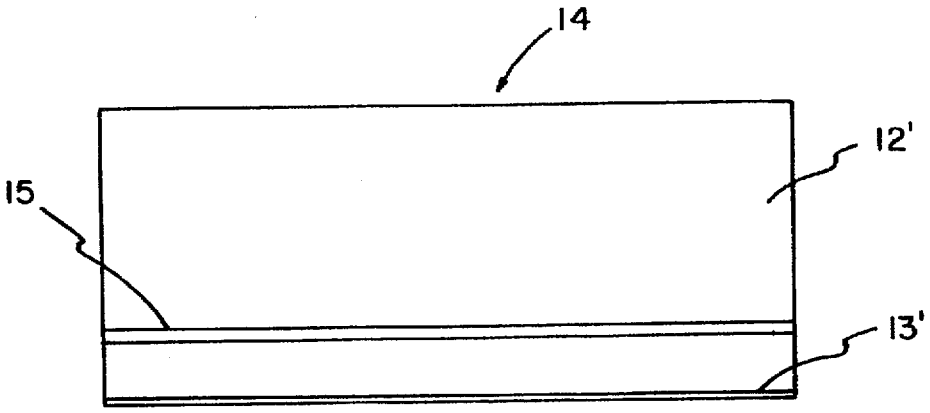
FIG. 2B is a front elevational view thereof.
Figure 2C:
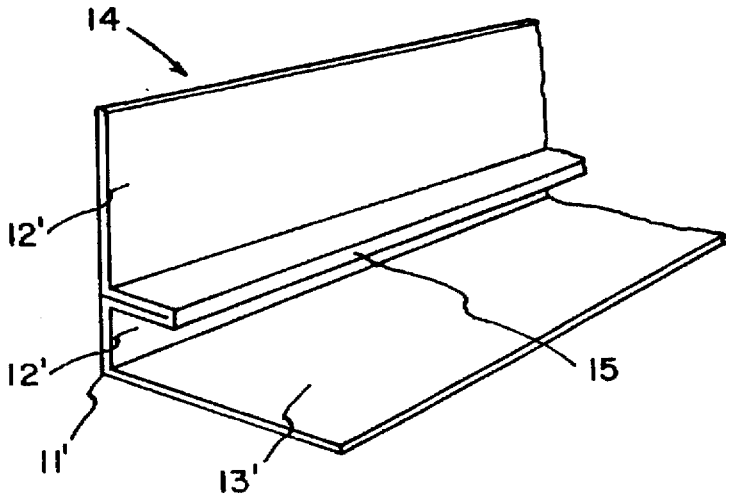
FIG. 2C is a fragmentary perspective view thereof.
Figure 3A:
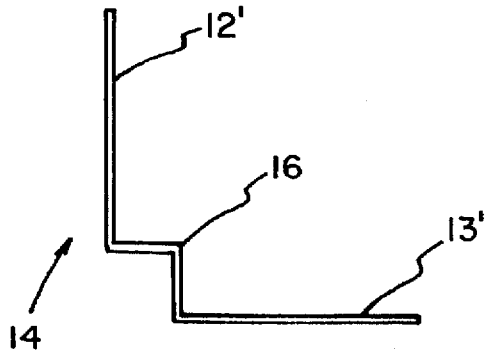
FIG. 3A is an end elevational view of a modification of the improved flashing shown in FIGS. 2A through 2C.
Figure 3B:
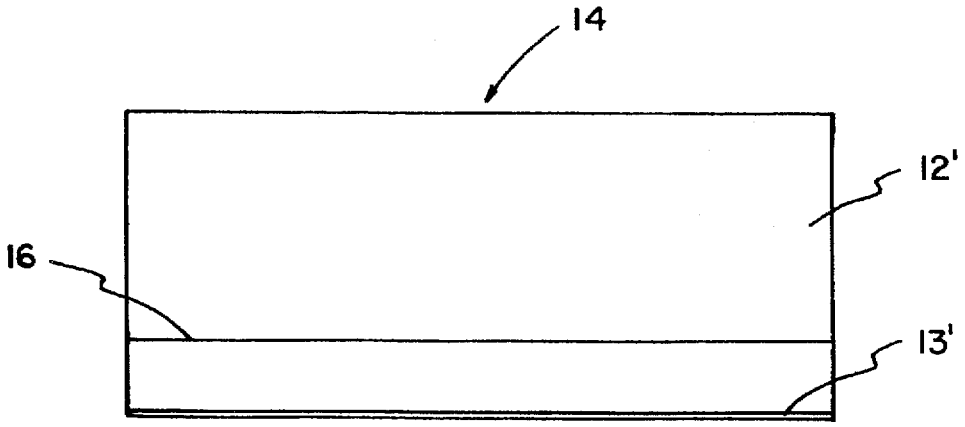
FIG. 3B is a front elevational view thereof.
Figure 3C:
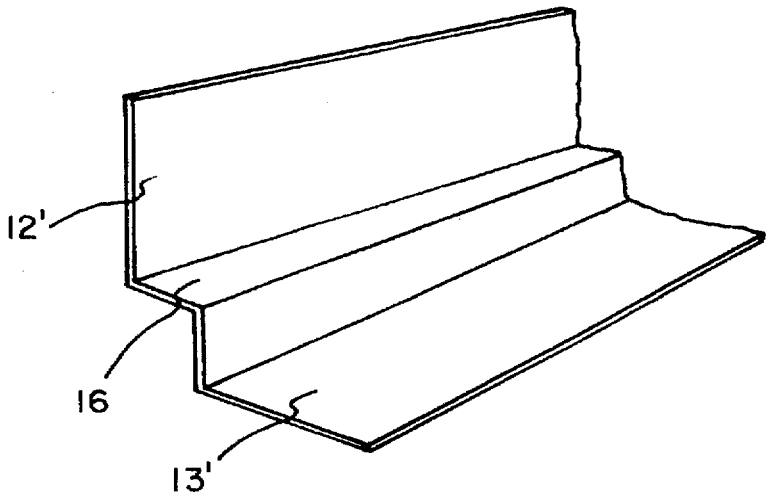
FIG. 3C is a fragmentary perspective view thereof.
Figure 4:
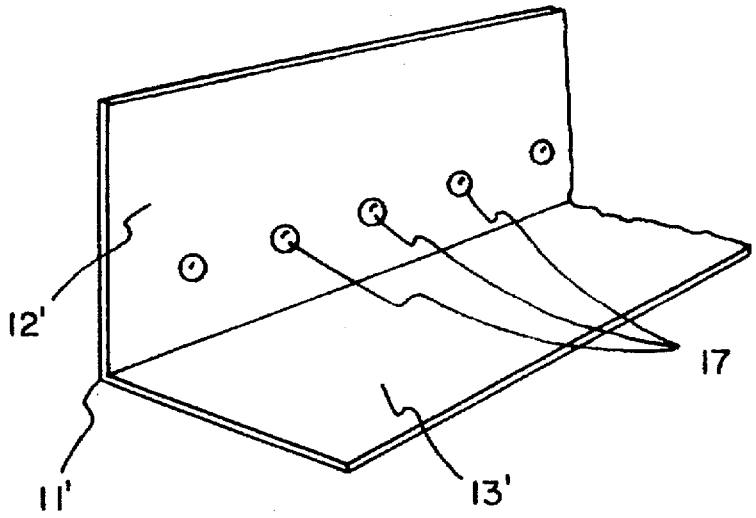
FIG. 4 is a fragmentary perspective view of a third version of the present invention.

In the version of the present invention shown in FIGS. 3A through 3C, a longitudinal shoulder guide 16 is formed at the juncture 11' of the vertical portion 12' and the horizontal portion 13'. This longitudinal shoulder serves the same purpose during construction as the double-crimp lip guide 15 in FIGS. 2A through 2C.

A plurality of dimples 17 or similar outward projections in vertical portion 12' can be used as a positive guide in locating the siding thereon. Being outwardly projecting, these various guide versions prohibit the siding from being installed over the flashing lower than the location of such guides since they would not fit flush.

Figure 5:
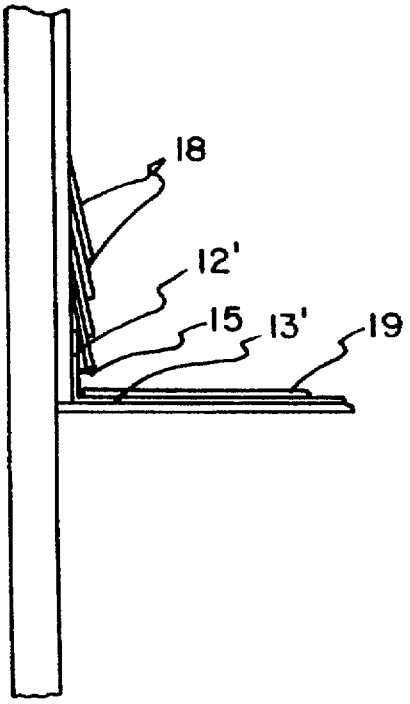
FIG. 5 is an end view showing the improved roof flashing of the present invention installed between wall siding and roof shingles.
Figure 6:
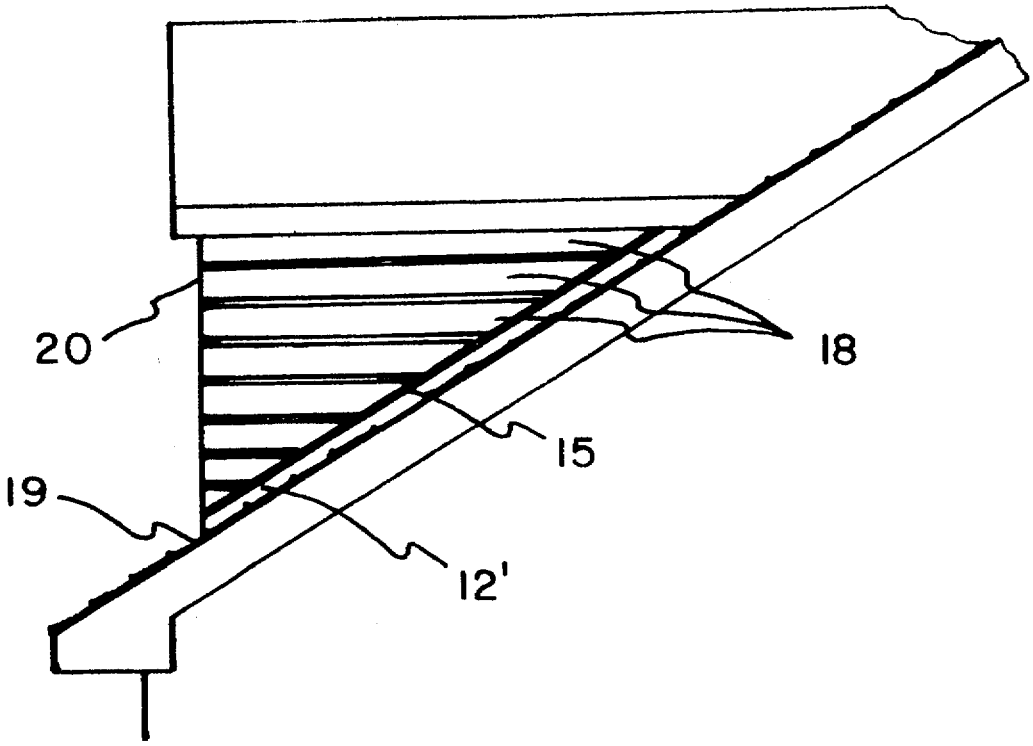
FIG. 6 is a side elevational view of the improved flashing of the present invention installed between a dormer wall and a shingled roof.

FIG. 5 shows the improved roof flashing of the present invention installed under the lower terminal edge 18' of primed lap siding 18 and roof shingles 19. FIG. 6 is a side elevational view of a typical dormer showing the improved roof flashing of the present invention properly installed under the siding 18 and roof shingles 19.

The dormer 20 shown in FIG. 6 is only an example of siding to roof structures. The present invention can, of course, be used with any other structure that requires flashing between siding being spaced from a roof.

From the above it can be seen that using the flashing of the present invention allows wall siding to terminate at a predetermined height above the roof. This is extremely beneficial in maintaining the clearance between the bottom of the wall siding and the roof to abate moisture penetration into the siding. The present invention is also a benefit in the fact that the siding installer can more accurately cut the edge of the siding closest to the roof since there is a definite terminal line.

Although flashing is predominately formed from sheet galvanized ferreous metal, aluminum and copper, vinyl, plastic and other materials could, of course, also be used.

The terms "vertical", "horizontal", etc. have been used herein merely for convenience and are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A flashing in combination with a vertical wall and roof for spacing siding on the vertical wall at the juncture with the deck roof deck at a predetermined spacing which prevents water runoff from being absorbed by the siding, the siding being chatracterized by a lower base wall and side walls extending upwardly therefrom and formed of a natural fibrous material susceptible to decay in the presence of water runoff along the juncture, said flashing comprising: a one-piece flashing member formed of a flexible constant thickness weather resistance metallic sheet material, said flashing member including a vertical panel located between the vertical wall and the siding and a base panel located on the deck, said vertical panel being integrally connected at a bent seam to said base panel; and a siding locator projecting, outwardly from said vertical panel toward said base panel and at the predetermined spacing thereabove, said siding locator having an upper surface engagable by the base wall of the siding and integrally formed in said vertical panel by mechanical displacement of said material whereby said siding is located at least the predetermined spacing above said roof deck.

2. The flashing in combination with a vertical wall and a roof deck as recited in claim 1 wherein said siding locator is a continuous double crimped longitudinally extending projection having an upper surface engaging the bottom wall of the siding.

3. The flashing in combination with a vertical wall and a roof deck as recited in claim 1 wherein said siding locator is a longitudinally aligned and extending series of outwardly extending projections formed in said vertical panel.

4. The flashing in combination with a vertical wall and a roof deck as recited in claim 1 wherein said siding locator is a stepped ledge formed integrally in said vertical panel including a continuous longitudinally extending outwardly projecting upper portion engagable with the bottom surface of the siding and spaced from said base panel by an integrally formed vertical portion having a height of about said predetermined spacing.

* * * * *